US005783086A

United States Patent [19]

Scanlon et al.

[11] Patent Number: 5,783,086

[45] Date of Patent: Jul. 21, 1998

[54] FILTER FOR A WET/DRY VACUUM CLEANER FOR WET MATERIAL COLLECTION

[75] Inventors: John J. Scanlon, Wilmington; Raymond M. Wnenchak, Newark; Richard W. Giannetta, Elkton, all of Del.

[73] Assignee: W. L. Gore & Associates, Inc., Newark, Del.

[21] Appl. No.: 701,142

[22] Filed: Aug. 21, 1996

Related U.S. Application Data

[63] Continuation of Ser. No. 536,511, Sep. 29, 1995.

[51] Int. Cl.[6] ..... B01D 61/00

[52] U.S. Cl. ..... 210/651; 210/654; 210/450; 210/416.1; 210/474; 96/6; 95/46; 55/215; 55/421; 55/DIG. 3

[58] Field of Search ..... 210/654, 651, 210/450, 500.26, 406, 416.1, 474; 96/6; 55/215, 421, 525, DIG. 3; 95/46; 604/283, 313, 320

[56] References Cited

U.S. PATENT DOCUMENTS

| | | | |
|---|---|---|---|
| 3,775,951 | 12/1973 | Eicholz et al. | 55/417 |
| 3,953,566 | 4/1976 | Gore . | |
| 3,962,153 | 6/1976 | Gore . | |
| 4,096,227 | 6/1978 | Gore . | |
| 4,187,390 | 2/1980 | Gore . | |
| 4,465,485 | 8/1984 | Kashmer et al. | 604/320 |
| 4,831,685 | 5/1989 | Bosyj et al. | 15/344 |
| 5,334,174 | 8/1994 | Street | 604/313 |
| 5,458,586 | 10/1995 | Adiletta | 604/283 |

FOREIGN PATENT DOCUMENTS

| | | |
|---|---|---|
| 0377907 | 7/1990 | European Pat. Off. . |
| 0500420 A1 | 8/1992 | European Pat. Off. . |
| 0 607 058 A | 7/1994 | European Pat. Off. . |
| 3405749 | 8/1985 | Germany . |
| 3536798A1 | 4/1986 | Germany . |

OTHER PUBLICATIONS

International Search Report for PCT/US96/13946.

(3) "Sears/Craftsman(R) 16–Gallon Ful Blowing Professional Wet/Dry Vac," Model No. 113.178492 16–Gallon Double Insulated Wet/Dry Vac, sold by Sears, Roebuck and Co., Chicago, IL 60684, Aug. 1991.

Literature: (1) "Genie(R) Wet/Dry Vas Owner Manual," Copyright 1994, The Genie Corp.

(2) "Shop–Vac(R) Wet/Dry Vacuum, Model 800E, 10.12 Gallon Wet/Dry Super Performance Owner's Manual," Shop–Vac Corporation, Williamsport, PA 17701, Copyright 1993.

*Primary Examiner*—Ana Fortuna

*Attorney, Agent, or Firm*—Victor M. Genco, Jr.; Carol A. Lewis White

[57] ABSTRACT

The present invention is an improved method of employing a wet/dry vacuum cleaner for wet material pick-up. By employing a hydrophobic and air permeable filter material, such as an expanded polytetrafluoroethylene (PTFE), with a tight gasket around its edge in place of a conventional wet/dry vacuum filter, it has been determined that the filter can be retained in place at all times during operation, regardless of the material being collected.

5 Claims, 6 Drawing Sheets

FILTER FOR A WET/DRY VACUUM CLEANER FOR WET MATERIAL COLLECTION

CROSS REFERENCES TO RELATED APPLICATION

This is a continuation of U.S. Ser. No. 08/536,511 filed on Sept. 29, 1995 pending.

BACKGROUND OF THE INVENTION

1. Field of the Invention

The present invention relates to improved methods for employing vacuum cleaner devices designed to handle both dry and wet cleaning situations.

2. Description of Related Art

A variety of vacuum cleaners are presently available that can effectively pick-up both dry and wet materials. These devices are found in a variety of forms, but all generally comprise a large holding tank with a suction unit mounted on top of the tank. Dry or wet materials are drawn through a hose into the holding tank during suction. These devices are sold by a number of companies under trademarks, such as SHOP VAC, SEARS CRAFTSMAN, GENIE, HOOVER, BLACK & DECKER, etc. This class of vacuum cleaner is commonly referred to as "wet/dry vacs."

In the case of dry material pick-up, it is important that dust blown into the tank of a wet/dry vac is not blown into the air outside the tank through the vacuum exhaust. In order to avoid this situation, all of these vacuums are sold with some form of filter mounted between the tank and the exhaust to contain dry dust contamination within the vacuum's tank. Typical filters sold with these vacuum cleaners comprise a flat or pleated paper that is attached to the base of the suction unit within the tank.

One common complaint of wet/dry vacs is that their filters are not suitable for use with wet materials. When the typical wet/dry vac filters are exposed to water or even wet materials (e.g., wet leaves), the water tends to wet-out the paper filters and quickly destroys them under the harsh conditions of vacuuming. Accordingly, manufacturers recommend that the conventional filters be removed whenever wet pick-up occurs. However, stores continue to do a brisk business in replacement filters for those individuals who have forgotten or refused to remove the filters when encountering wet conditions.

Wet vacuum cleaning is further complicated by a number of other factors. First, while wet dirt and the like are inclined to stay in the tank and not become entrained into the exhaust from the vacuum, the cleaning of mixed dry and wet materials without a filter in place usually leads to dust spewing from the exhaust. Second, even in instances where only liquid is being collected, the liquid tends to become aerosolized and exhausted from the vacuum. Third, most wet/dry vacs include cut-off valves to prevent liquid from being drawn through the suction unit when the tank becomes filled with liquid. However, these valves tend to engage only at the last minute, usually resulting in at least some spillage or dispersion of liquid from the vacuum cleaner.

The foregoing illustrates limitations known to exist in present methods for employing a wet/dry vacuum. Thus, it is apparent that it would be advantageous to provide improved methods directed to overcoming one or more of the limitations set forth above. Accordingly, a suitable alternative is provided including features more fully disclosed hereinafter.

SUMMARY OF THE INVENTION

The present invention is an improved method of employing a wet/dry vacuum cleaner ("wet/dry vac") for wet material pick-up. By employing a hydrophobic and air permeable filter material, such as an expanded polytetrafluoroethylene (PTFE), with a tight gasket around its edge in place of a conventional wet/dry vac filter, it has been determined that the filter can be retained in place at all times during operation, regardless of the material being collected.

Preferably, the present invention comprises a method for employing a wet/dry vacuum for collecting wet material that comprises: providing a filter cartridge comprising a hydrophobic and air permeable filtration membrane and a liquid-tight gasket, the filtration membrane being sufficiently hydrophobic so as to withstand repeated exposure to water without degradation; providing a wet/dry vacuum, the vacuum having a tank, a suction unit and an air exhaust; mounting the filter cartridge on the suction unit of the wet/dry vacuum such that the filtration membrane is disposed in a predetermined location below a rim of the tank; and employing the wet/dry vacuum to collect wet material, wherein when a predetermined amount of wet material is collected and the filtration media is completely covered by said wet material, wet material collection is ceased thereby preventing overflow of said collected wet material from said tank.

DESCRIPTION OF THE DRAWINGS

The operation of the present invention should become apparent from the following description when considered in conjunction with the accompanying drawings, in which.

DETAILED DESCRIPTION OF THE INVENTION

The present invention employs an expanded polytetrafluoroethylene (PTFE) membrane laminate filter cartridge in a wet/dry vac to provide effective filtration for collection of both dry and wet material. In accordance with the present invention, the filter cartridge may be used during wet or dry pick-up with no risk of filter degradation or diminished filtering capabilities during wet pick-up.

Figure 1:
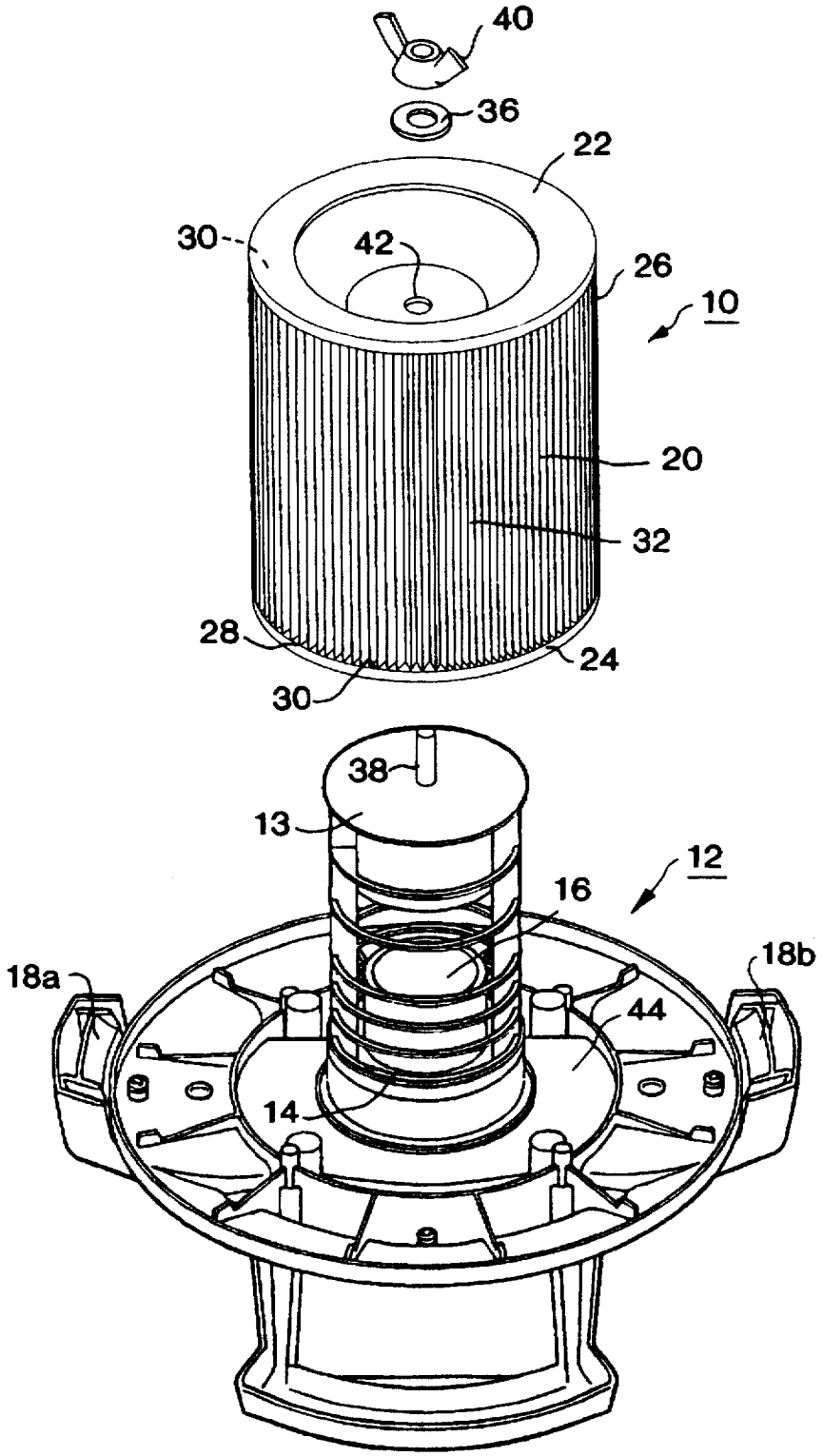
FIG. 1 is a perspective view of the bottom of one embodiment of a filter for use in the present invention shown in exploded orientation above a suction unit of a conventional wet/dry vac.

FIGS. 1–5 illustrate embodiments of a filter cartridge 10 for use with the present invention. FIG. 1 shows the filter cartridge 10 mounted on a suction unit 12 of one form of commercially available wet/dry vacuum cleaner. The wet/dry vac shown is a Model 917744 SEARS CRAFTSMAN wet/dry vac available from Sears, Roebuck & Co., Chicago, Ill.

Typical of most wet/dry vacs, the vacuum cleaner illustrated in FIG. 1 comprises the suction unit 12 that mounts on top of a tank 53 (FIG. 6) for collecting contamination in the form of dirt, dust, water and other liquids, for example. The suction unit 12 includes an opening (not shown) to which a vacuum cleaner hose is attached, an exhaust 14, a safety valve 16 for shutting off the suction unit 12 when liquid fills the tank, and catches 18*a*, 18*b* for securing the suction unit 12 to the tank.

A conventional wet/dry vac of this type employs a pleated paper filter on a hub 13 of the suction unit to filter dirt and dust before it reaches the vacuum motor or the vacuum exhaust 14. As has been noted, the paper and fabric filters work adequately for dry particle pick-up, but will rapidly degrade when exposed to water and other liquids. Accordingly, the paper filter must be removed prior to liquid or wet material collection. A further problem with paper filters is that they are not easily cleaned (with cleaning primarily limited to shaking or lightly brushing the filter). Accordingly, the filters are generally not cleaned, but are merely thrown away when they become filled with dust.

In accordance with the present invention, an extremely durable filter cartridge is provided that includes filtration media that is capable of being exposed to repeated exposures to water without degradation. Particularly preferred is a hydrophobic material that provides a barrier to liquid penetration. Suitable filtration materials that can be used with the present invention include: expanded polytetrafluoroethylene (PTFE) membrane; expanded ultra high molecular weight polyethylene (UHMW PE) membrane; microporous open cell polymers (such as, polyurethane foam); or dense paper filters treated to be hydrophobic (such as treatment with a Milease F-95 treatment available from Zeneca Inc., Wilmington, Del., or a SCOTCH GUARD brand treatment available from 3M, St. Paul, Minn.), for example.

It is particularly preferred to employ an expanded PTFE filter with the present invention. Expanded PTFE made in accordance with U.S. Pat. Nos. 3,953,566, 3,962,153, 4,096,227, and 4,187,390, all incorporated by reference, is formed by heating and rapidly expanding PTFE in at least one direction. When processed in this manner, the expanded PTFE forms a microscopic structure of polymeric nodes interconnected by fibrils. Space between the nodes and fibrils are micropores that allow the passage of air and water vapor, but are too small to permit passage of liquid water or even fine water droplets.

The expanded PTFE filter material for use with the present invention comprises a single layer of expanded PTFE membrane, approximately 0.2 to 0.127 mm thick. The final sheet ideally has the following properties: porosity of 70% to 95%, and a permeability range of 2 to 60 or more cfm/ft$^2$ at 12.7 mm (0.5 inch) $H_2O$. Preferably, the sheet comprises a thickness of 0.02 to 0.05 mm, a porosity of 90 to 95%, and permeability of 5 to 10 cfm/ft$^2$ at 12.7 mm (0.5 inch) $H_2O$.

Pore size measurements may be made by the Coulter Porometer™, manufactured by Coulter Electronics, Inc., Hialeah, FL. The Coulter Porometer™ is an instrument that provides automated measurement of pore size distributions in porous media using the liquid displacement method (described in ASTM Std. F316-86). Air permeability may be measured by clamping a test sample in a gasketed flanged fixture which provided a circular area of approximately 3827 mm$^2$ (69.85 mm diameter) (6 square inches (2.75 inches diameter)).for air flow measurement. The upstream side of the sample fixture is connected to a flow meter in line with a source of dry compressed air. The downstream side of the sample fixture is open to the atmosphere. Testing is accomplished by applying a pressure of 12.7 mm (0.5 inch) of water to the upstream side of the sample and recording the flow rate of the air passing through the in-line flowmeter (a ball-float rotameter). The sample is conditioned at 70° F. and 65% relative humidity for at least 4 hours prior to testing. Results are reported in terms of Frazier Number which is air flow in cubic feet/minute/square foot of sample at 12.7 mm (0.5 inch) water pressure.

The filter material is then laminated to a porous backing material, such as a porous polyester nonwoven, paper, felt, sintered polypropelene, polyethylene, polyimide, polyamide, etc. In order to increase exposed surface area, the filter material can then be folded into multiple pleats and then installed in a "rippled" or "pleated" orientation into the filtration apparatus. The pleated material can be formed into a cylinder or "tube" and then bonded together such as through the use of an adhesive (e.g., hot-melt glue, etc.), or ultrasonic welding, for example.

Figure 2:
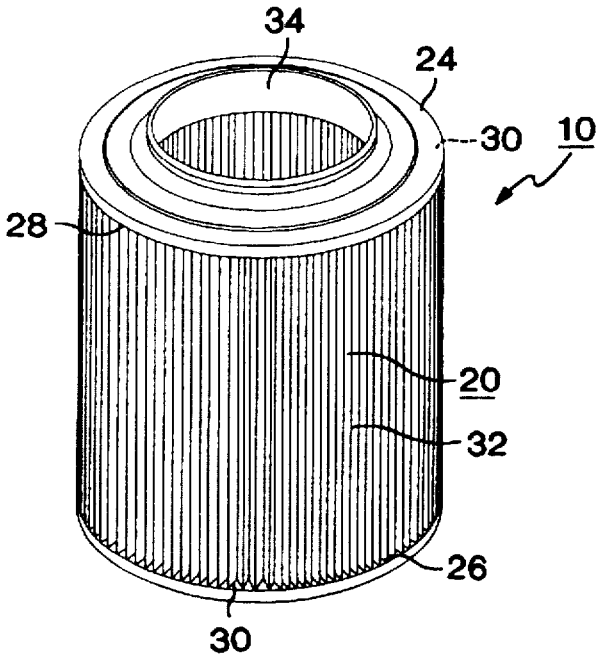
FIG. 2 is a perspective view of the top of the filter unit shown in FIG. 1.

As is shown in FIGS. 1 and 2, the final composite filter sheet material 20 is preferably pleated into a tube having approximately 0.5 to 3 pleats per cm. To form the filter cartridge 10 from the tube, the tube is mounted with an end plate 22 at one end and a tight gasket element 24 at its opposite end. The end plate 22 and gasket element 24 are ideally provided with grooves 26, 28, respectively, into which the filter sheet 20 is mounted. The filter sheet 20 can be held in the grooves through any suitable means, including through the use of an adhesive, or a potting compound 30, for example. It is important that the seal between the filter sheet 20 and the end plate 22 and the gasket element 24 are liquid tight so as to avoid leakage therethrough.

The gasket element 24 can be formed from any suitable material that will retain its elastic and conformable properties over time and can provide a snug and air, liquid-tight seal. A preferred material for the gasket is: urethane, such as GORE BOND I3P3 brand urethane available from W. L. Gore & Associates, Inc., Newark, Del.

It should be understood that the filter used in the present invention may be constructed in a variety of manners. For instance, the end cap 22 may be constructed from any suitable material such as plastic or metal (preferably non-corrosive metal), for example. Further, it may be possible to employ a filter with no end cap, using instead a gasket element on both sides of the filter.

As is shown in FIG. 2, the filter cartridge 10 for use in the present invention is formed with non-corrosive parts so as to avoid rust and other problems that can be encountered with wet material collection. Preferably, as is shown, the filter is formed from a sufficiently stiff and resilient filter sheet that does not require a cage, perforated core, or other internal stiffener to maintain the shape of the filter during use.

Especially preferred for use with the present invention is to employ a pleated filter sheet where tips 32 of the pleats have been treated to protect against wear and damage of the filter media along the tips 32 of the pleats during use. The preferred pleats are treated by heat and pressure deification and/or polymer coating. The filter cartridge 10 may be supported by hub 13, 52 as shown in FIGS. 1 and 3, respectively.

When constructed in the manner disclosed, the filter cartridge 10 has one open end 34 surrounded by the gasket element 24 that is adapted to snugly fit over the exhaust section of the suction unit 12 of the wet/dry vac. The precise shape and proportions of the gasket element 24 will vary between different wet/dry vacs. Additionally, various wet/dry vacs have different mounting mechanisms to secure the filter in place. For example, the filter unit shown in FIG. 1 includes a washer 36, bolt 38, and adjustable nut 40. The bolt 38 passes through an opening 42 in the end plate 22 to hold the filter cartridge 10 in place on the suction unit 12. The gasket element 24 forms a tight fit against a sealing surface 44 on the suction unit 12 in this embodiment when retained in place using the bolt 38 and nut 40.

Figure 3:
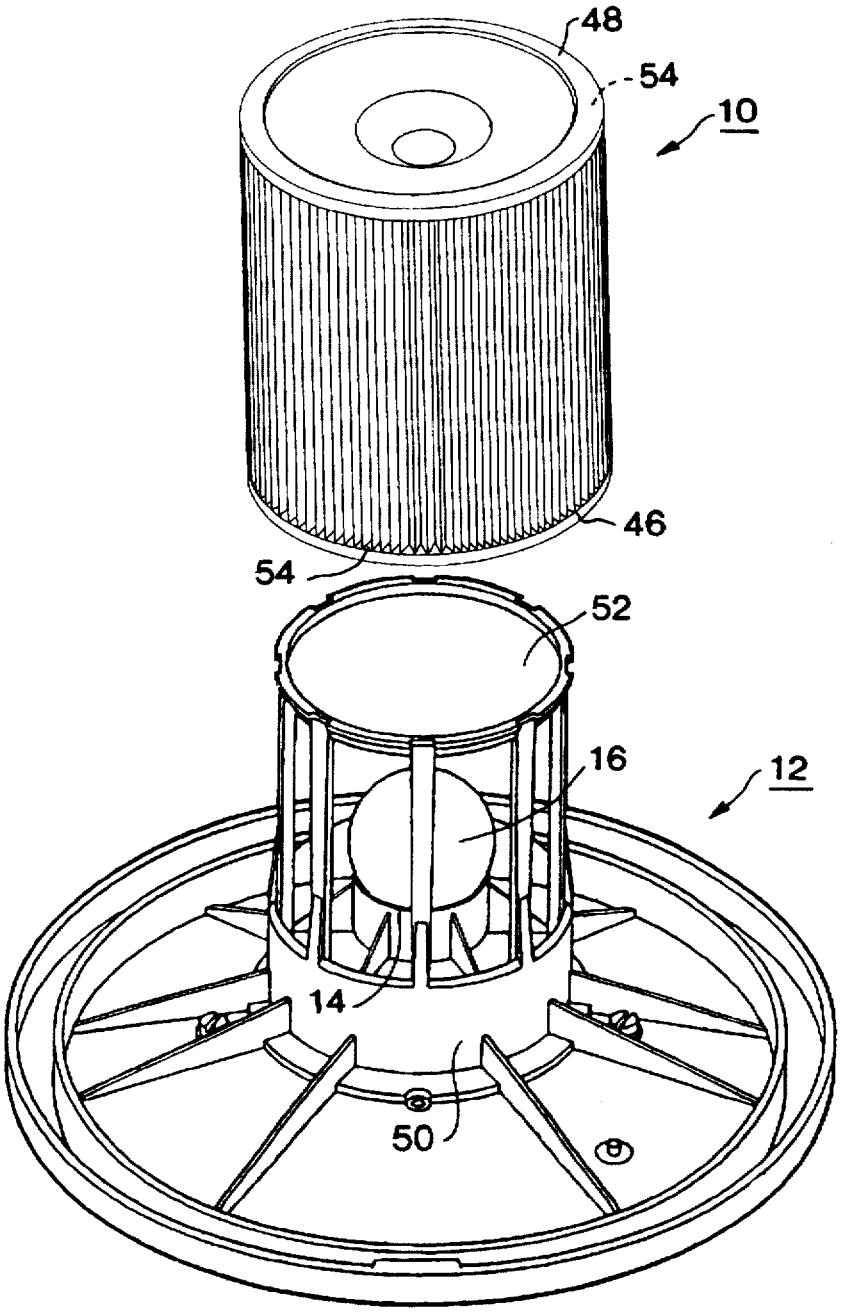
FIG. 3 is a perspective view of the bottom of another embodiment of a filter for use in the present invention shown in exploded orientation above a suction unit of another brand of conventional wet/dry vac.

Another embodiment of wet/dry vac that can be employed with the present invention is shown in FIG. 3. This drawing represents a suction unit for a SHOP VAC brand wet/dry vacuum, Model 500A. Conventional filters on this type of wet/dry vac are held in place using an elastic band or mounting ring around the paper filter. In order to adapt an expanded PTFE filter to this application, a modified gasket element 46 has been provided that holds the filter cartridge in place on the suction unit 12 without the need of separate mounting means. As is shown, the end plate 48 in this embodiment contains no mounting hardware and merely provides a tight seal to the interior of the filter cartridge. The gasket element 46 forms a tight fit against sealing surface 50 around hub 52 to prevent liquid from passing through to the exhaust of the vacuum cleaner. Again, an adhesive or potting material 54, or similar material is used to form a tight seal on the ends of the filter material.

The present invention employs the above described filter cartridges in the following manner. First, the filter cartridge is mounted on the wet/dry vacuum cleaner in the manner previously described so as to form a liquid tight seal between the tank and the vacuum cleaner exhaust. Next, the vacuum cleaner is employed in a conventional manner to pick-up debris. When liquid or wet material is encountered, no modification to the vacuum need occur. The durable vacuum filter combined with a liquid tight seal around the filter assures that liquid will not destroy the filter and provides an effective barrier to liquid escaping from the tank.

Among the important advantages of the process of the present invention is that aerosolized liquid that is generated when liquid is drawn into the tank is also effectively filtered. With liquid pick-up using conventional wet/dry vac operation, liquids tend to form a fine mist or "aerosol" that will attack and destroy conventional paper and cloth filters causing liquid leakage through the exhaust once the filter becomes saturated. If the vacuum cleaner is run without a filter, the aerosol will spew out the vacuum cleaner's exhaust. The filter employed with the present invention provides a barrier to the escape of aerosolized liquid from the tank, with liquid mist condensing on the filter and dripping down into the tank. This provides significant benefits by effectively containing the aerosolized liquid while also protecting the suction unit 12 from contamination or attack by the liquid. These benefits are particularly desirable where the wet/dry vac is being used to collect corrosive, hazardous, noxious, or similar materials where complete containment is important. In fact, it is believed that this aspect of the present invention may allow conventional wet/dry vacs to be used for many new applications that were previously impossible due to the risk of aerosolizing and dispersing hazardous liquid substances.

Another important feature of the present invention is that the present invention provides for more secure liquid pick-up. Until the present invention, the collection of liquid has always been a constraint for wet/dry vac operation. Since the vacs can collect a large amount of liquid in a relatively short period of time, there is always a distinct risk that the tank will completely fill with liquid and the liquid will then be expelled from the exhaust or sucked into the motor or fan on the unit. In order to avoid this problem, wet/dry vacs include some form of shut-off valve 16 to prevent liquid from overfilling the tank. The problem with these valves is that they tend to engage only at the last minute and some liquid spillage can occur.

Figure 6:
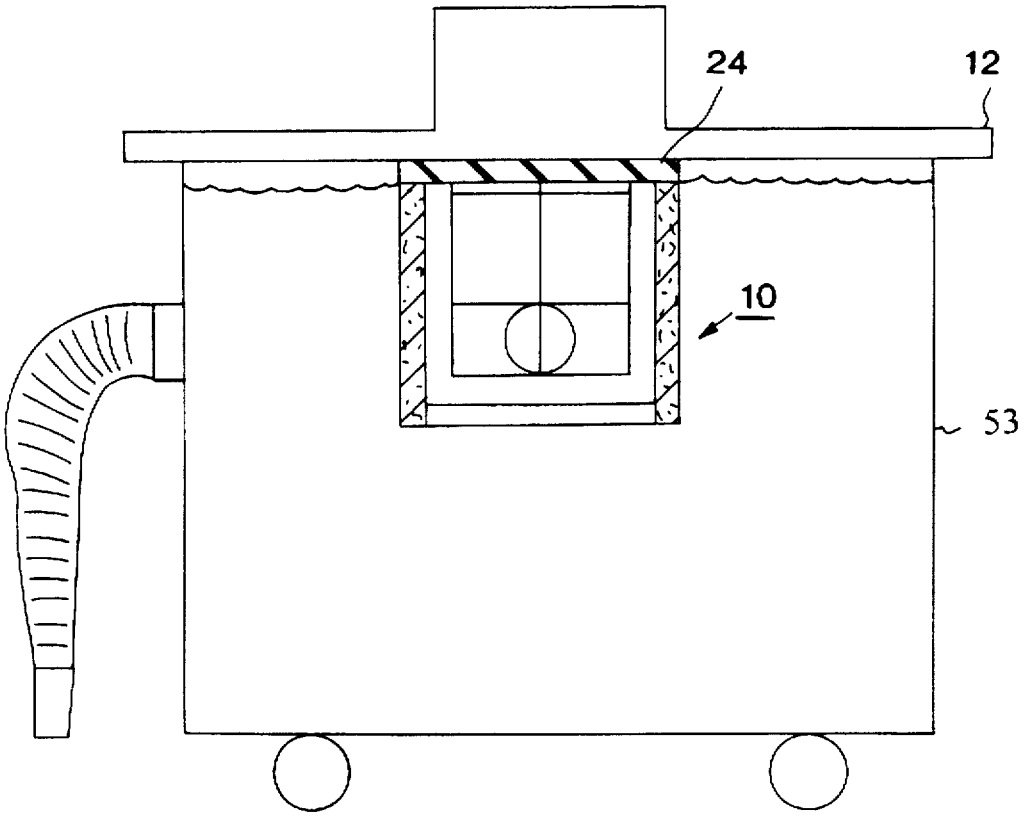
FIG. 6 is a partial sectional view of a wet/dry vacuum cleaner in accordance with the present invention.

As best seen by reference to FIG. 6, with the present invention, the filter unit itself serves as an extremely effective valve to prevent any liquid from exiting the tank 13. If the unit completely fills with liquid with a filter of the present invention in place, suction will diminish and cease as the filter becomes covered with liquid. In this instance, the only risk of spillage is the release of liquid in the vacuum cleaner hose back to the area being cleaned when the drum is completely filled. Accordingly, when employed with a conventional wet/dry vac, the filter provides an additional layer of protection that liquid will not overfill the tank. Further, the filter unit employed with the present invention is so effective at isolating liquid from the exhaust, that it is believed possible to completely dispense with a shut-off valve entirely from the wet/dry vac. This provides a cost savings for the manufacturer and allows for the construction of simpler, lighter, and easier to assemble wet/dry vac units.

Figure 4:
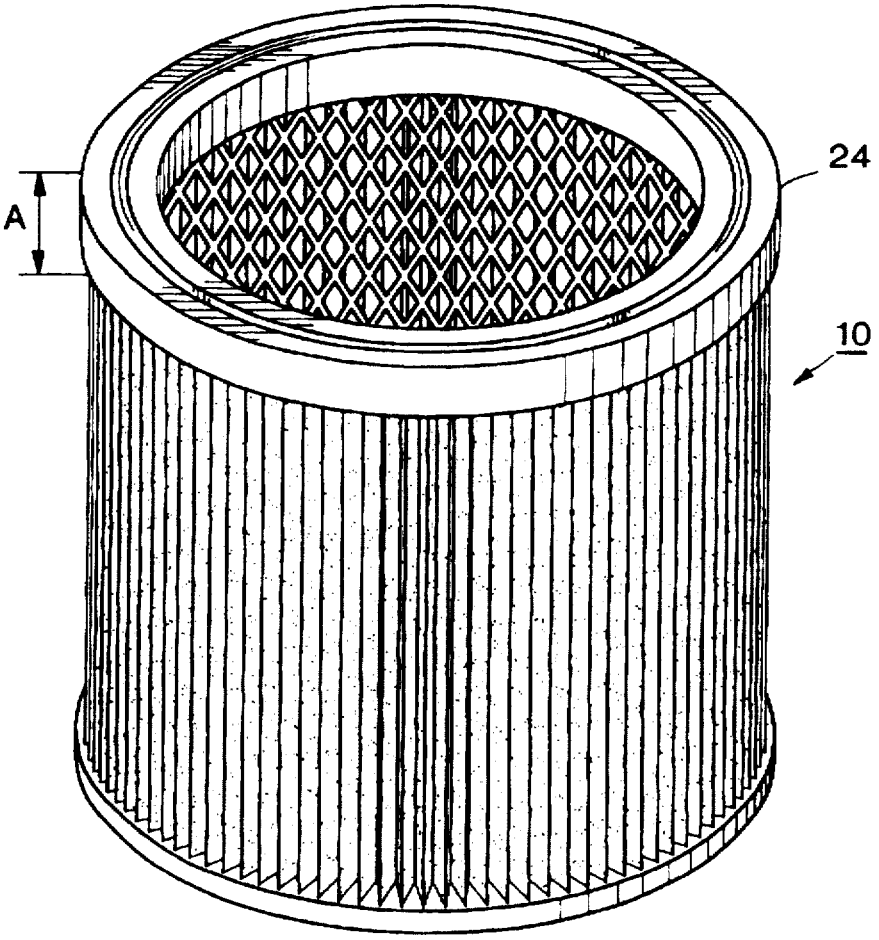
FIG. 4 is a perspective view of an alternate embodiment of a filter in accordance with the present invention.
Figure 5:
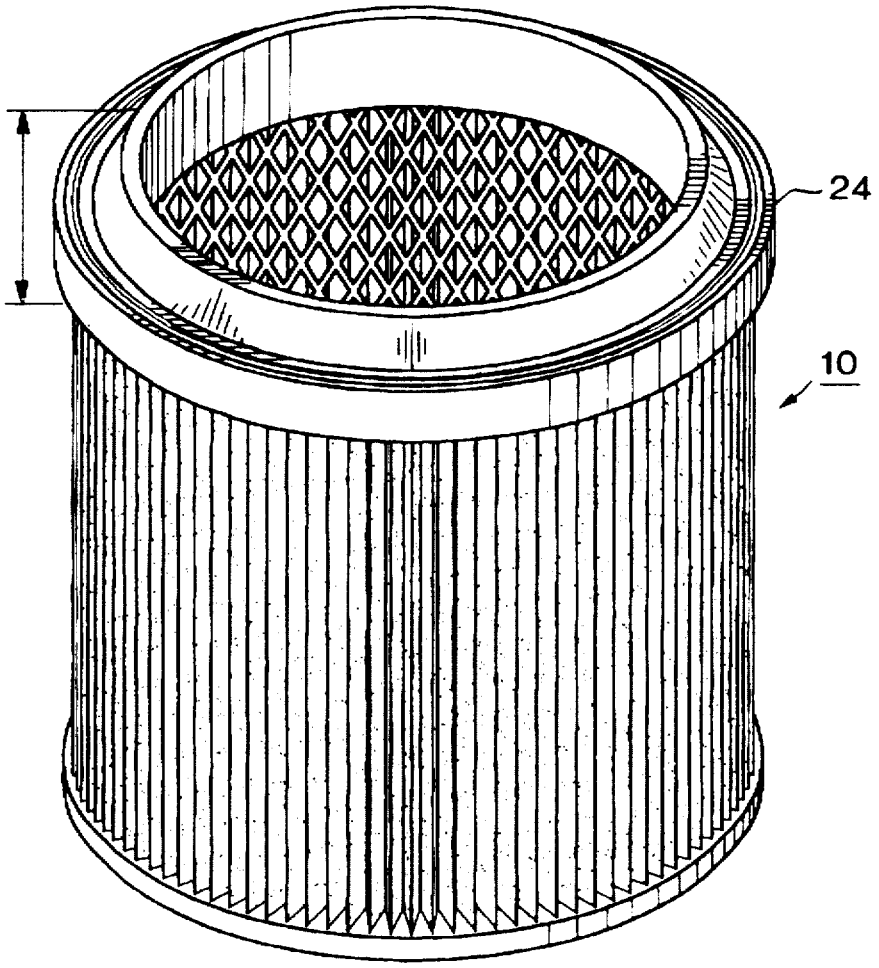
FIG. 5 is a perspective view of an alternate embodiment of a filter in accordance with the present invention.

As best seen by reference to FIGS. 4 and 5, a mounting means may be employed to locate the filtration sheet below a top rim portion of the tank 13. More particularly, in one embodiment of the present invention, the gasket 24 defines a predetermined length, as measured axially along the filter 10 and shown by reference line "A", to locate the filter below a top surface of the suction unit 12. Preferably the gasket 24 defines a predetermined length which locates the filter sheet ¾" to 2" below the top surface of the suction unit 12. This novel technique allows the tank to fill with liquid until the liquid level reaches the bottom of the gasket 24, completely covering the filter sheet. At this point, the filter sheet 20 is complete submerged in liquid and airflow can no longer penetrate the media. Therefore, the vacuum cleaner stops collecting liquid and spillage is avoided from the tank. As best seen by FIG. 5, the gasket 24 may be under-cut to allow operators to fit their fingers between the gasket and the suction unit. This allows an operator to obtain a good grip on the filter so that the filter can be removed from the lid.

In cases in which a suction unit is recessed so that the gasket 24 is above a top portion of the suction unit rim when the suction unit is installed on tank 13, the mounting means may comprise a separate spacer. In this case, a separate ring may be used to space the gasket 24 below the top of the suction unit rim. The spacer must be of a design which allows the filter to be secured to the suction unit in a leak-free manner. Referring to FIG. 6, vacuum cleaners may also be designed so that the support hub or cage on which the filter 10 mounts is positioned so that the gasket 24 is below a top rim portion of tank 13.

Still another important benefit of the process of the present invention is that the filter can be easily removed, fully cleaned, and then re-mounted in the vacuum cleaner. Since the filter employed with the present invention is completely waterproof, the filter can be completely washed inside and out of dirt and contamination with no compromise of the filtration efficiency of the filter. As a result, the operative life of the filter when used in conjunction with the present invention is dramatically increased over conventional filters.

Finally, the filter used in the present invention provides dramatic improvements over previous wet/dry vac operations. As has been explained, currently manufacturers recommend that filters be removed from the wet/dry vac when liquid or wet material pick-up occurs. In these instances, the vacuum cleaners effectively operate with little or no filtration occurring. This unfortunately results in dust dispersion from the vacuum when wet and dry material is simultaneously collected. Another problem is that conventional wet/dry filters provide only marginal filtration efficiencies even when the paper filters are in place.

By contrast, the filter employed with the present invention provides excellent particle filtration at all times. The preferred expanded PTFE filter for use in the present invention provides a filtration efficiency of 60 to 99%, or more, at 0.3 microns. Ideally, the filter has an efficiency of 99.7 to 99.9 at 0.3 microns. This is extraordinary performance, as compared with conventional wet/dry vac filters, which typically have a filtration efficiency of about 10 to 20% at 0.3 microns when operated dry and virtually no long-term filtration efficiency when operated wet.

Without intending to limit the scope of the present invention, the following examples illustrate how the present invention may be made and used:

EXAMPLE 1

A cartridge for use in the present invention was constructed by first taking an expanded PTFE membrane, made in accordance with U.S. Pat. No. 3,953,566 to Gore, with the following properties:

A permeability of 21 $ft^3$/min and 0.5 inch $H_2O$. A Mullen burst of about 2 psi and a thickness of approximately 2 mils (0.05 mm).

This material is commercially available from W. L. Gore and Associates Inc., Newark, Del., under the trademark GORE-TEX.

The expanded PTFE membrane material was laminated to a 6 oz Reemay Style 2024 polyester thermoplastic nonwoven acquired from Reemay, Inc., Old Hickory, TN. Lamination was accomplished by applying 260° C. heat and 206 KPa (30 psi) pressure for a period of about 0.1 seconds. The resulting laminate had the following properties:

A permeability of 9 $ft^3$/min at approximately 0.5 inch $H_2O$ and a Mullen burst tester measurement of about 150 psi.

The Mullen's burst test (Federal Std. 191A, Method 5512) is performed in the following manner. The test consists of clamping a test specimen in a fixture, applying water under pressure against the inner surface, and visually observing the outward facing surface of the specimen until the specimen ruptures (Burst). The pressure at which these events occur is recorded.

The laminate was then pleated using a pleating machine. The pleated pack was then sealed together into a cylinder using a DEXTER HYSOL® 232 EVA hot melt glue. This cylinder was then attached to a gasket on one end and an end plate on the opposite end. The attachment between the filter material and the gasket and end plate was sealed using a urethane potting compound, GORE BOND I3P3 available from W. L. Gore & Associates, Inc., of Newark, Del.

This filter was employed in a 16 Gallon SEARS CRAFTSMAN Wet/Dry Vac. The vacuum cleaner was used to pick-up water from a tub and it did so without any water or mist spraying out of the exhaust of the vacuum. Once the tank of the vac was filled with water, with the filter totally surrounded by water, the flow stopped and no water exited the exhaust.

While particular embodiments of the present invention have been illustrated and described herein, the present invention should not be limited to such illustrations and descriptions. It should be apparent that changes and modifications may be incorporated and embodied as part of the present invention within the scope of the following claims.

Having described the invention, what is claimed is:

1. A method for employing a wet/dry vacuum for collecting wet material that comprises:

providing a pleated filter cartridge comprising a hydrophobic and air permeable filtration membrane and a liquid-tight gasket, the filtration membrane being sufficiently hydrophobic so as to withstand repeated exposure to water without degradation;

providing a wet/dry vacuum, having a tank, a suction unit and an air exhaust;

mounting the pleated filter cartridge on said suction unit such that a space is created between the filter cartridge and a rim of the tank; and employing said wet/dry vacuum to collect wet material, wherein when wet material is collected and the filtration membrane in the filter cartridge is completely covered by said wet material, wet material collection is ceased thereby preventing overflow of said collected wet material from said tank.

2. The method of claim 1 that further comprises:

providing as the filtration membrane an expanded polytetrafluoroethylene membrane.

3. The method of claim 1 that further comprises:

employing the filter cartridge for both dry and wet material pick-up, whereby the filter cartridge provides dust filtration.

4. A wet/dry vacuum cleaner comprising:

a tank having an interior volume and a top rim portion;

a suction unit;

a pleated filter cartridge comprising a hydrophobic and air permeable filtration membrane and a liquid-tight gasket, the filtration membrane being sufficiently hydrophobic so as to withstand repeated exposure to water without degradation; and means for mounting said pleated filter cartridge within said interior volume of said tank, such that a space is created between said filter cartridge and the top rim portion of said tank, wherein a mean is provided such that when wet material is collected in said tank during operation of said wet/dry vacuum cleaner, and the filtration membrane in the filter cartridge is completely covered by said wet material, wet material collection is ceased, thereby preventing overflow of such collected wet material from said tank.

5. The wet/dry vacuum cleaner of claim 4, further comprising providing as the filtration membrane an expanded polytetrafluoroethylene membrane.

* * * * *